United States Patent [19]

Speiser

[11] 3,950,634

[45] Apr. 13, 1976

[54] KEYBOARDS

[76] Inventor: Meyer Speiser, 1617 50th St., Brooklyn, N.Y. 11204

[22] Filed: Feb. 19, 1974

[21] Appl. No.: 443,608

[52] U.S. Cl. ..... 235/145 R; 340/365 R
[51] Int. Cl.[2] ..... G06C 7/02; G06C 25/00
[58] Field of Search..... 235/145, 146; 340/365 R, 340/365 S; 197/98, 19

[56] References Cited

UNITED STATES PATENTS

| | | | |
|---|---|---|---|
| 2,261,115 | 11/1941 | Hofgaard | 235/145 R |
| 2,727,689 | 12/1955 | Heindorff | 235/145 R |
| 3,022,878 | 2/1962 | Seibel et al. | 340/365 R |
| 3,096,019 | 7/1963 | Frenkel | 235/145 R |
| 3,319,884 | 5/1967 | Franklin | 235/145 R |
| 3,428,747 | 2/1969 | Alferieff | 340/365 R |
| 3,705,424 | 12/1972 | Harvey, Jr. | 235/145 R |

*Primary Examiner*—Stephen J. Tomsky
*Attorney, Agent, or Firm*—Philip Furgang

[57] ABSTRACT

The device of this invention has a housing disposed to fit over the nine keys or push-buttons, numbered 1 through 9 of a push-button array of a calculator or push-button telephone, or the like. Push-button operating means are provided with U-shaped members for receiving human digits. Three of such push-button operating means are disposed along columnar openings in the housing and are resiliently held in a position which corresponds to the second row of the three rows of push-buttons in a standard array. A push-button is movably secured to the U-shaped member and extends therethrough to a finger element. When the push-button is depressed, the finger element to which it is connected depresses the push-button in the center row of the array. When the human finger is pushed against one of the concave-shaped walls of the U-shaped member, the push-button operating means moves along the column to one of the other rows. Within the housing is a wheel which is resiliently connected to the push-button operating means. The wheel engages a track member secured to a housing wall. As the wheel is guided along the track, it moves downwardly until it contacts the push-button in an outer row of the push-button array. The push-button operating means further comprises a slide which is integrally connected to the U-shaped member. The slide is resiliently held in its position by a coil spring. In another context of this invention, the push-buttons are arranged along walls of a U-shaped housing as an integral part of a calculator or the like. At the base of the U is the center row of push-buttons and on the opposed walls of the U-shaped housing are the two other rows of push-buttons. These devices enable the user to move along either one of two predetermined paths to operate any one of three rows of push-buttons, thereby reducing the movement to operate the push-buttons.

4 Claims, 13 Drawing Figures

KEYBOARDS

BACKGROUND OF THE INVENTION

This invention relates to keyboard means and more particularly to an arrangement of discrete signal operating elements intended for manual operation.

Various attempts have been made to arrange keyboards in a convenient manner. Most of these arrangements comprise the movably affixing of push-buttons to walls of a housing, presenting a substantially planar pattern. Within this context of planar arrangement the buttons have been variously arranged from the now all too familiar desk calculators and push-button telephones to the older and well-established calculators, typewriter keyboards and the like.

From time to time, some effort has been made to alter this arrangement with only limited success. Thus, Hofgaard (U.S. Pat. No. 2,261,115) discloses a plurality of planar disposed keys wherein the keys are in close proximity to one another and in stepped relationship thereto. Thus, in operation, one or more keys are pressed at the same time. While this arrangement clearly makes for a more compact keyboard, it presents the same operational difficulties as will be discussed hereinafter in connection with the flat or planar keyboard arrangement currently in use.

Still another suggestion is proposed by Taylor (U.S. Pat. No. 2,628,030). Taylor discloses a substantially planar key arrangement with several of the keys, such as the add or subtract button, having bevelled edges and at least three of the numeral keys having a concave top surface so that the operator may simply and easily locate his hands on the keyboard. However, like Hofgaard and the others herein, Taylor presents the similar flat keyboard arrangement.

Heindorff (U.S. Pat. No. 2,727,689) presents buttons lying in concave configuration. The difficulty with this arrangement is that the fingers must still move from one key position to another.

Frenkel (U.S. Pat. No. 3,096,019) discloses five switches each having an intermediate position. The operator merely pivots the switch from one position or another to actuate numbers zero through nine. While this particular system is compact, it is in no way adaptable to presently existing push-button arrangements. Further, the pivot arrangement requires an education of the user as to which numbers are in which location. Thus, a calculator constructed in connection with the teachings of Frenkel would require the user to be reeducated in a manner different from that commonly used.

Clearly, in order to improve the efficiency of one using a calculator-type push-button array of buttons would be to arrange those buttons such that the user would be able to reduce movement to a minimal direction. As presently constituted, the established buttons require a plurality of movements first in one direction followed by a downward movement upon the button. With this requirement there is an obvious loss of efficiency and a consequent loss of time.

SUMMARY OF THE INVENTION

An object of this invention is to provide a keyboard means which increases the efficiency of and reduces the possibility of errors in the operation of calculators or the like.

It is another object of this invention to provide keyboard operating means which are both economical in manufacture and simple in use.

It is the further object of this invention to provide a keyboard for calculators and the like, or, in the alternative, a device for the operation of a predetermined array of push-buttons of a calculator, telephone, or the like which in its use requires little physical movement and changes of a direction thereby being more efficient and accurate.

It is the further object of this invention to provide an improved keyboard for calculators, telephones, or the like.

In accordance with this invention, there is provided a keyboard means for use in calculators, cash registers, telephones or the like. The keyboard means comprises a housing means and signal producing means. The signal producing means comprise a plurality of discrete manually operated element means which are movably secured to the housing. These element means are so disposed such that a single human digit can contact and operate a first and second of these elements by moving along a first predetermined path in either a first or second direction and a third of the elements can be operated by the same human digit moving along a second predetermined path. The second predetermined path is substantially perpendicular to the first path. The orientation of the elements is such that the first and second elements define a plane and the third element is psaced from that plane.

DESCRIPTION OF THE PREFERRED EMBODIMENTS

Figure 1:
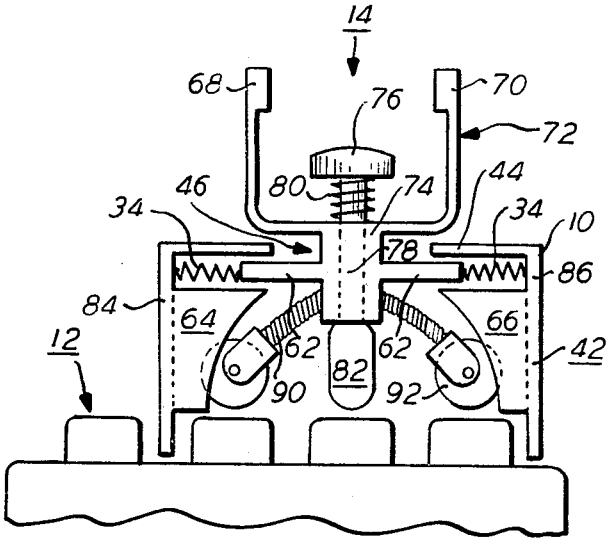
FIG. 1 is a sectional, side view showing one operating position of a keyboard means constructed in accordance with the teachings of this invention.
Figure 2:
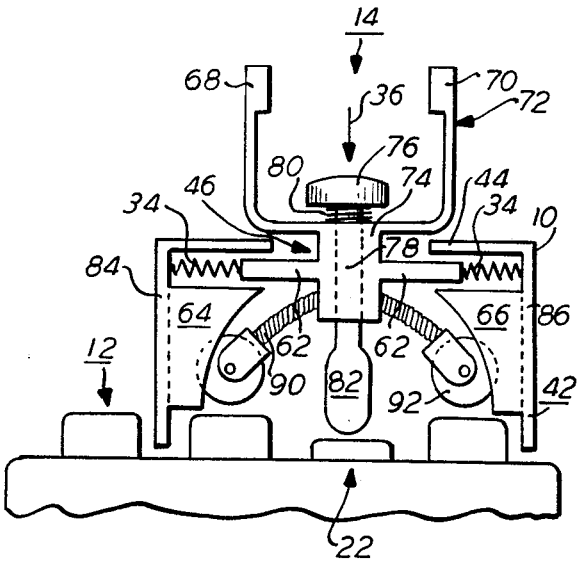
FIG. 2 is another sectional, side view showing another operating position of the keyboard means of FIG. 1.

FIGS. 1 through 7 disclose a push-button operating means for use with a predetermined keyboard array such as that found on telephones, calculators, and the like. A housing 10 (FIGS. 1–6) may be placed over a keyboard 12 (FIGS. 1–4). Push-button operating means 14, 16, and 18 are disposed over the keyboard 12.

Thus, if, for example, a keyboard, such as that found on a telephone, is used, there may be presented three rows 20, 22, and 24 and columns 28, 30, and 32 (FIG. 4) of push-buttons 26 which may be assigned numerals 1 through 9. The push-button operating means 14, 16, and 18 may be disposed to move along the three columns 28, 30, and 32.

Figure 4:
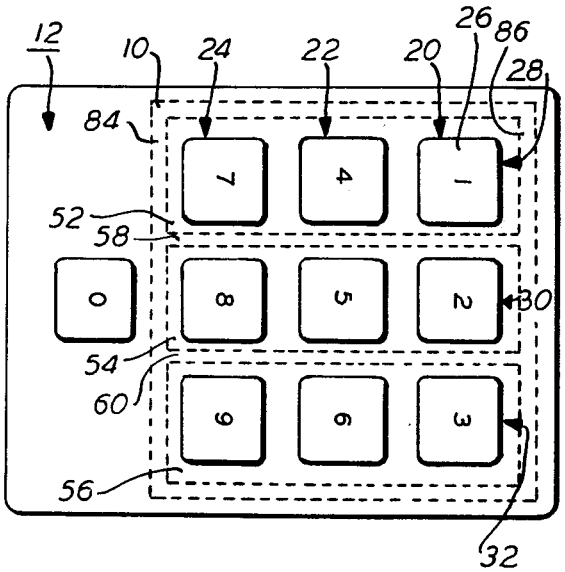
FIG. 4 is a plan view of a typical keyboard array indicating the placement thereon of the keyboard means of FIG. 1.
Figure 5:
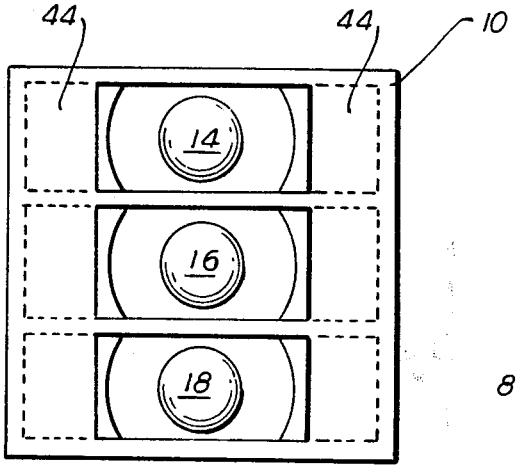
FIG. 5 is a plan view of the keyboard means of FIG. 1.
Figure 6:
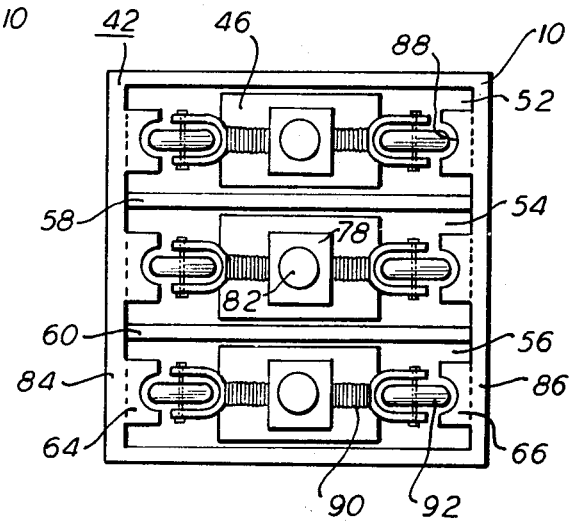
FIG. 6 is a bottom view of the keyboard means of FIG. 1.

In accordance with the current art, the first column 28 may include push-buttons 26 assigned digit values 1, 4, and 7 respectively. Then second column 30 may have push-buttons 26 comprising digit values 2, 5, and 8 respectively. The third column 32 may have push-buttons 26 assigned digit values 3, 6, and 9 respectively. Each of the push-button operating means 14, 16, and 18 are disposed to move along their respective columns 28, 30, and 32 to activate any of the push-buttons 26 in the aforementioned columns 28, 30 and 32. Thus, the housing 10 may be disposed over the matrix of nine push-buttons 26 (FIG. 4).

Figure 3:
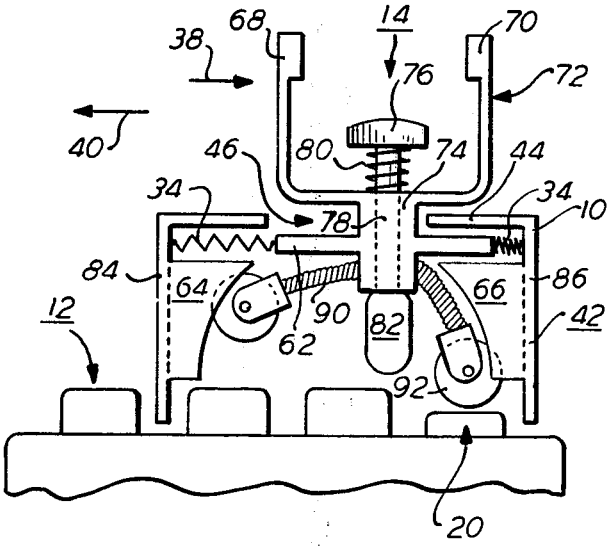
FIG. 3 is still another sectional, side view showing another operating position of the keyboard means of FIG. 1.

The push-button operating means 14, 16, and 18 may be held resiliently in registry with the second row 22 of the three rows 20, 22, and 24 of push-buttons 26. This resiliency may take the form, for example, of metallic coil springs 34 (FIGS. 1–3 and 7) affixed to the push-button operating means 14, 16, and 18 as will be more fully described hereinafter. Held in this position, a downward push upon any one of the three push-buttons 76 (FIGS. 1–3) of the push-button operating means 14, 16, and 18 (see arrow 36 in FIG. 2) will cause push-button operating means 14, 16, and 18 to operate the push-buttons 26 of the keyboard 12 of the center or second row 22 which, as previously indicated may be assigned digit values 4, 5, and 6. The same human fingers which would depress the push-button operating means 14, 16, and 18 may also push the push-button operating means 14, 16, and 18 along the columns 28, 30, and 32, respectively, either upward or forward into the first or top-most row 20 or backwards into the bottom or lowermost row 24 of the array 12. These movements are indicated by the arrows 38 and 40 (FIG. 3). Means are provided, operably connected to the push-button operating means 14, 16, and 18, to engage any of the push-buttons 26 in the associated column 28, 30, or 32 and rows 20, 22, or 24.

Thus, a push-button operating means works in this manner: three center fingers of the operator are inserted within the push-button operating means 14, 16, and 18. A downward motion, in the direction of arrow 36, at the initial or steady state position of the push-button operating means 14, 16, or 18 would operate push-buttons 26 in the second or center row 22. A forward or upward motion, in the direction of arrow 38, would operate the push-buttons in the first row 20 and a reverse motion, arrow 40, of the fingers would cause an operation of the push-buttons 26 in the third row 24.

As disposed herein, the manual motion which requires the user to move first parallel to the plane in which the push-buttons are located and then to move perpendicular to that plane to operate the push-buttons is converted by the devices herein to a unidirectional motion for operating push-buttons. Thus, for example, the push-buttons 26 in the second row 22 may be operated by the movement of a human finger in a downward direction (arrow 36). The push-buttons 26 in the first and third row 20 and 24 may be operated by moving in a direction parallel to the columns of buttons 26. Thus, the operation of the push-buttons is greatly simplified.

Figure 7:
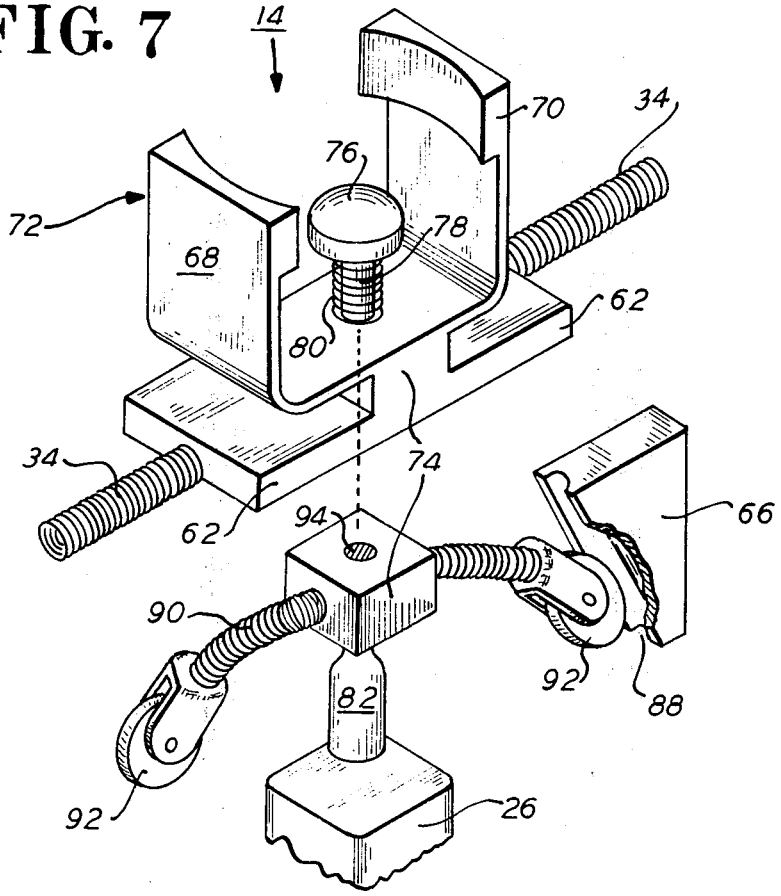
FIG. 7 is a perspective, exploded view of a portion of the keyboard means of FIG. 1.

With particular reference to this invention shown here, the housing 10 takes the form of a rectangular box-like structure which may be made of any structural material such as plastic, metal, or the like. The housing 10 in this example may have four side walls 42 and a top wall 44 (FIGS. 1–3, 5 and 6). The bottom of the box-like housing 10 may be open to fit over the keyboard 12 and thereby locate the push-button operating means 14, 16, and 18 with respect to the push-buttons 26 of the keyboard 12 (FIG. 4). The top wall 44 may have therein slots or openings 46 (FIGS. 1,6) with the housing 10 placed over the push-button array 12, these slots 46 may be in registry with the columns 28, 30, and 32, respectively. The box-like housing 10 may be divided into three substantially rectangular sections 52, 54, and 56 (FIGS. 4 and 6) defined by two walls 58 and 60. Each of these sections 52, 54, and 56 has confined thereto one of the push-button operating means 14, 16, and 18 respectively. One of the sections 52, 54, or 56 will serve as a description of all of the sections 52, 54, and 56. Thus, for example, a push-button operating means mechanism comprises a slide 62 (FIGS. 1 and 7). The slide 62 may comprise, for example, a substantially planar piece of rigid material of metal, plastic, or the like which may, for example, be rectangular in shape and be disposed proximate the top wall 44 within the housing 10 and covering one of the rectangular slots 46. The slide 62 may be held movably in place by two opposed members 64 and 66 (FIGS. 1, 3, and 7) secured to the walls 84 of the housing 10 which are intended to be parallel the rows of a keyboard 12. The members 64 and 66 may be formed as an integral portion of the housing walls 42 or may be secured thereto by glue or other means.

The push-button operating means 14 may, in addition, comprise finger retaining sleeve members 68 and 70 which form the upstanding walls of the general U-shaped configuration 72. The base 74 of the U-shaped configuration 72, which extends above the top wall 44 of the housing 10, may be secured by a stem 78 to the slide 62.

The push-button operating means 14 may further comprise a push-button 76 having a push-button stem 78, secured thereto by means well known in the art which may pass through an aperture (not shown) in the base 74 of the U-shaped member 72, its base 74, and slide 62. The push-button 76 may be, as is well known in the art, mounted for resilient movement with respect to the U-shaped member 72 by means of a metal coil spring 80 or the like. A push-button cylindrically shaped finger 82 may have a larger diameter than the hole through which the stem 78 passes (so as to lock the push-button 76 in place within the slide 62 and may be secured to the stem 78). Thus, a downward push on the push-button 76 may cause a push-button 26 to be operated by the push-button finger 82.

The push-button operating means 14 may be movably secured in its initial position (i.e., coincident with row 22 of a push-button array 12) resiliently mounted with respect to the housing 10. The two springs 34 may be secured from the slide 62 to row-facing side walls 84 and 86 respectively of the housing 10 thereby resiliently holding the push-button operating means 14 in the initial position in the center row 22 of the three-row 20, 22, and 24 array 12. It is to be noted that the springs 34 extend parallel the columns defined by sections 52, 54, and 56. Each of the members 64 and 66 presents at its innermost face thereof track-like camming surfaces 88 (FIG. 7) which extend from the top wall 44 and adjacent the row side of a slot 46 and down toward the row-facing side wall 84 or 86 respectively, terminating and spaced from a space allocated for a push-button 26 of either the top or bottom rows 20 or 24, respectively. Extending from the base 74 of the push-button operating means 14 may be, for example, two spring-loaded arms 90 which may comprise, for example, two metal coil springs (FIGS. 1–3 and 7) with a flexible material, such as rubber, therewithin to give it both support and strength. At the free ends of the spring-loaded arms 90 may be secured wheels 92 (FIG. 7) for engaging the camming track surfaces 88.

In operation, in the initial position the push-button 76 is depressed causing the finger 82 to depress a push-button 26 in the second row 22. To go from the initial or second row 22 to either rows 20 or 24, the user merely moves (for example, as in FIG. 3) to the top row 20 by placing pressure against one of the finger retaining members 70 and moving in the direction of the arrow 38. This motion causes the wheel 92 to track in the camming surface 88 downwardly until it depresses a push-button 26. A stop may be used to halt the motion of the push-button operating means 14. Thus, the slide 62 may be so employed. The same operation may be had by moving in the reverse direction or in the direction of the arrow 40.

Thus, as previously indicated, the motions in operation of the push-button are converted from bidirectional to unidirectional thereby causing a saving of effort and time.

Figure 8:
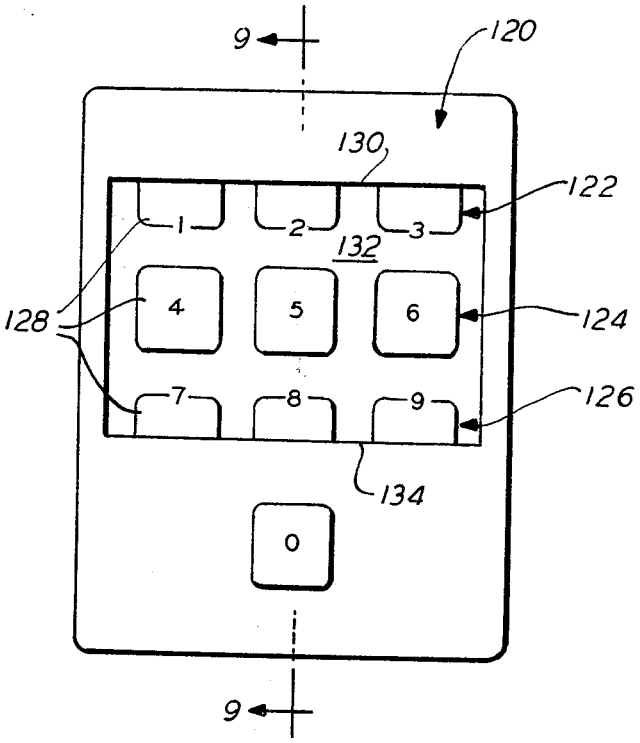
FIG. 8 is a plan view of another embodiment of a keyboard means constructed in accordance with the teachings of this invention.
Figure 9:
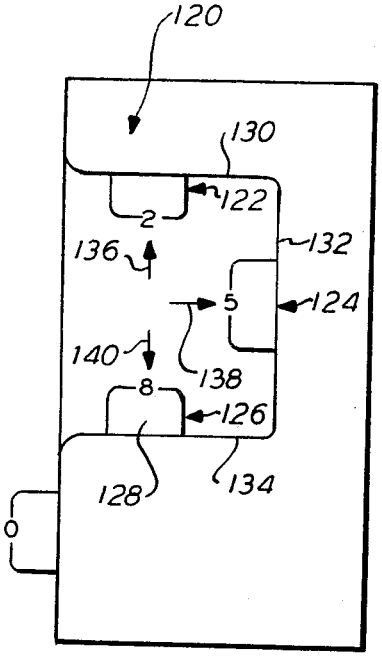
FIG. 9 is a sectional view of the keyboard of FIG. 8 taken along line 9—9.

Turning to another embodiment of this invention, for original equipment, one may see in FIGS. 8 and 9 a similar and related concept. Thus, there is provided a housing 120 (FIGS. 8 and 9). This housing 120 may comprise the actual push-button housing of a calculator, a telephone switchboard or may comprise some interlocking means of the type as previously disclosed herein above or any other means. Here push-buttons 128 may be movably secured to the housing 120 in a manner well known in the art. The housing wall, however, is generally of U-shaped configuration. Thus, the usual three rows 122, 124 and 126 of push-buttons 128 may be disposed along each of the three walls of the U-shaped housing to obtain the advantages disclosed by this invention. A first row 122 which may, for example, comprise push-buttons 128 assigned, for example, digit values 1, 2, and 3, may be movably secured to an upstanding first wall 130. The second row 124 of push-buttons 128 may be secured to the base wall 132 of the U-shaped configuration of the housing 120 and comprise push-buttons 128 assigned, for example, digit values 4, 5, and 6. Finally, push-buttons 128 in a third row 126 may be affixed to the opposing upstanding wall 134 of the U-shaped housing 120 and comprise push-buttons 120 assigned, for example, digit values 7, 8, and 9. Thus, each finger of the operator would be expected to have only a unitary motion in order to operate any of the push-buttons 128. A motion directly along one path, in one direction (arrow 136) would operate the push-buttons in a first row 122. A downward thrust of a finger (again in one direction), would operate the push-buttons in the second row 124 (arrow 138) (FIG. 9). Finally, the motion along the path against the opposed wall 132 would operate push-buttons 128 movably secured to that upstanding wall 134 (in the direction of arrow 140) (FIG. 9).

Figure 10:
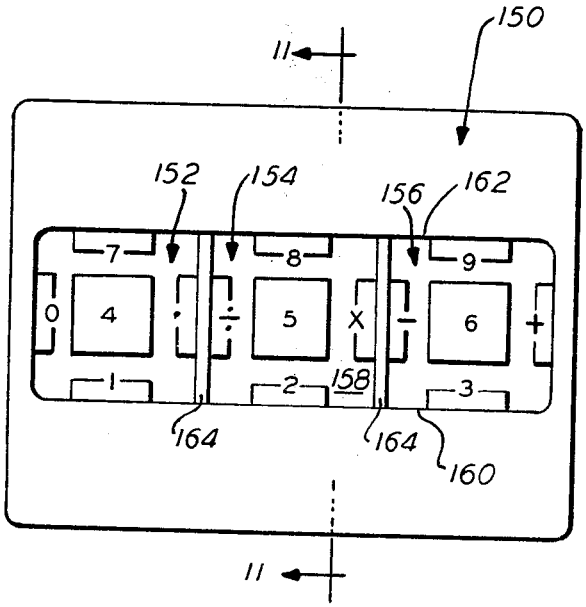
FIG. 10 is a plan view of still another embodiment of a keyboard means constructed in accordance with the teachings of this invention.
Figure 11:
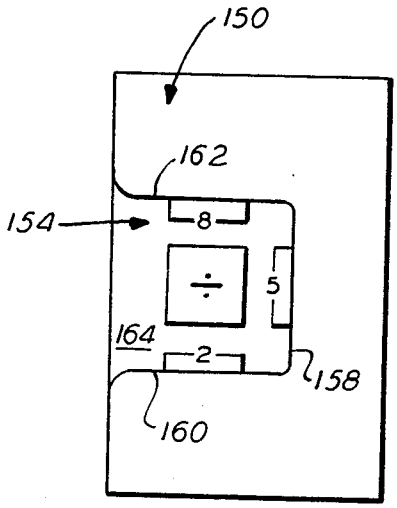
FIG. 11 is a sectional view of the keyboard of FIG. 10 taken along the line 11—11.

In still another embodiment of this invention, (FIGS. 10 and 11) should one use a numeric keyboard of the type proposed by Raytheon Corp., in which the keyboards are made out of an electrically responsive elastomeric material, it may be possible to provide a housing 150 to form the device in which the thin side walls and bottom walls of three cube-shaped containers 152, 154, and 156 form the keyboard for a calculator. Thus, as seen in FIGS. 10 and 11, the horizontal wall 158 may be assigned digit values 4, 5, and 6. One opposed vertical side wall 160 may be assigned digit values 1, 2, and 3 and the other opposed vertical side wall 162 (FIGS. 10 and 11) may be assigned digit values 7, 8, and 9. The ends or closing members 164 of the open containers 152, 154, or 156 may be assigned the zero digit, plus, minus, or any other operations needed in calculator use. Here again, the motion for operation would be comprised to unidirectional rather than the bidirectional method currently employed on keyboard switches.

Figure 12:
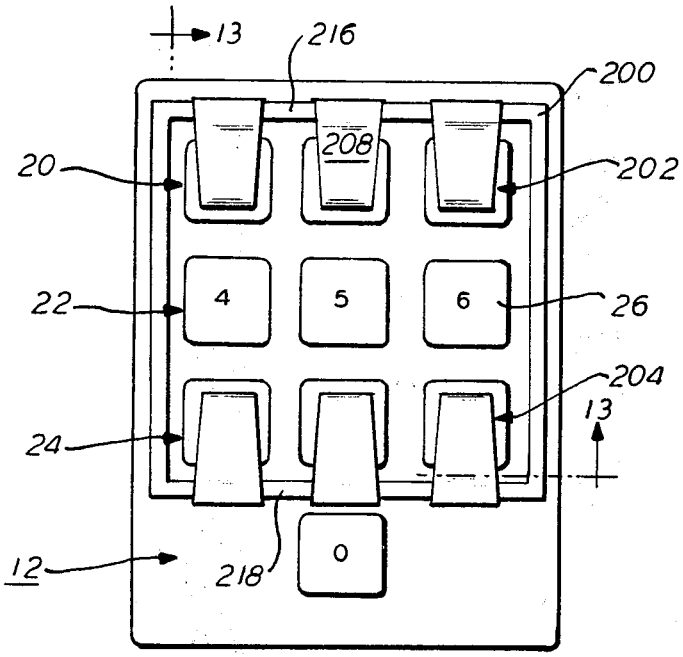
FIG. 12 is a plan view of a further embodiment of a keyboard means constructed in accordance with the teachings of the invention.
Figure 13:
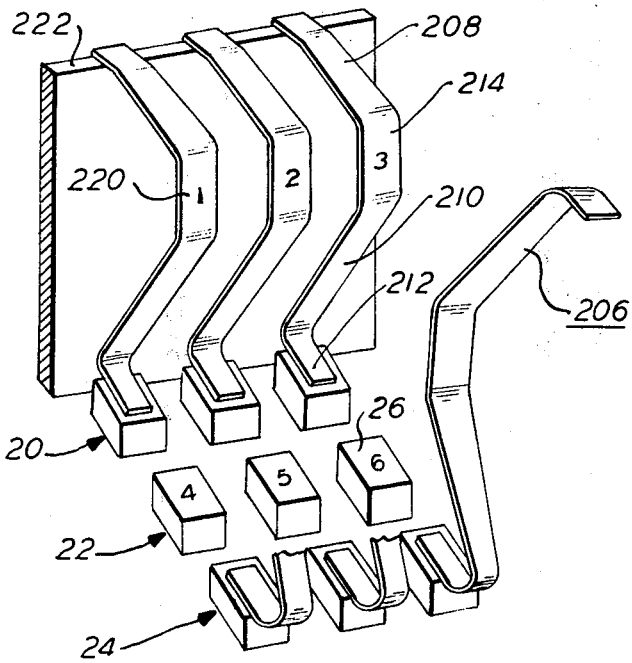
FIG. 13 is a sectioned, perspective view of the keyboard of FIG. 12 taken along the line 13—13.

In still another embodiment, there is suggested a more simplified version of the method of converting the bidirectional motion to unidirectional motion in the operating of a keyboard. Thus, a housing 200 may be placed about a nine push-button array 12. The housing 200 may comprise four upstanding walls made of any well-known rigid material such as plastic or the like. The housing 200 is open at both ends (FIGS. 12 and 13) and presents two rows 202 and 204 of spring-mounted fingers 206. Each spring-mounted finger 206 comprises a substantially U-shaped member. Thus, one leg 208 of the U-shaped member 206 is secured at the topmost portion 222 of the housing 200.

The opposed leg 210 of the U-shaped member 206 may extend back toward the housing wall and may extend downwardly at an angle thereto. The leg 210 may have a lateral leg 212 which is intended to abut a push-button. In the alternative, the lateral leg may terminate in a loop or rounded off portion (not shown). The purpose of the leg 212 will be more fully described below. The final vertical leg 214 or base of the U-shaped member 206 extends from the first to the second substantially opposed legs 208 and 210. It will be understood that the U-shaped member 206 does not form a perfect U, but is somewhat curved or arched.

One row of U-shaped members 206 is disposed along a wall 216 parallel the top row 20 of push-buttons 26. In the same manner, another row of U-shaped members 206 may be connected to a second wall 218 parallel the third row 24 of push-buttons 26. The second lateral leg 212 comes into contact with the push-buttons 26.

In operation, the user places his fingers within the housing 200. By pressing directly downward on the second row 22 of push-buttons 26, the user may operate push-buttons 26 assigned, for example, digit values 4, 5, and 6. By push either forward or backward, the user may cause the spring U-shaped members 206 or 214, to press inwardly which, in turn, forces one leg downwardly upon the push-buttons 26. Thus, by pressing on the perpendicular walls 214 the force is translated into a downward direction, thereby causing the push-buttons in contact with the U-shaped member to be operated. The result, is a simplified version of the devices disclosed herein for operating a keyboard by unidirectional motion. For convenience, digit values 220 may be described on the vertical member 214 of the U-shaped fingers 206 or 214 (FIG. 13) for purposes of identification.

Thus, there is presented herein means for converting present keyboard operations as well as constructing new keyboards, to take advantage of unidirectional motion, while not disturbing the arrangement of rows and columns of numbers currently used in calculator and telephone switch button arrays.

What is claimed is:

1. Means for operating the push-button of a keyboard, the keyboard having its push-buttons arranged in a matrix; said push-buttons operating means comprising:

housing means cooperatively engagable with the matrix; and push-buttons operating means movably secured to said housing; said push-button means comprises a plurality of discrete manually operable element means movably secured to said housing so that a single human finger operates a first and a second of said elements by moving along a first predetermined path in either a first or second direction; said element means comprises resilient fingers disposed so as to be capable of engaging at least one row of the push-buttons.

2. Keyboard operating means, as recited in claim 1, wherein said resilient fingers are disposed so as to engage two rows of the push-button matrix and have a space therebetween to accommodate the human fingers and permit access to a third row of the push-button matrix.

3. Keyboard operating means, as recited in claim 2, wherein said resilient fingers each comprise a generally U-shaped member, comprising first and second legs, and one vertical or base leg, said vertical leg interconnecting said first and second legs, said first leg being connected to said housing.

4. Keyboard operating means as recited in claim 3, wherein said housing comprises four upstanding, rectangular walls joined at the edges thereof to form a box open at the top and bottom thereof and so dimensioned as to fit about the matrix; two of said walls of said housing being substantially parallel to the rows of push-buttons; said first leg of each of said resilient fingers being secured to the top edge of said parallel walls and extending within said box, each of said second legs being so disposed as to be capable of engaging at least one of the push-buttons of the push-button row immediately adjacent to said wall to which the said resilient member is affixed, said second leg comprising means secured thereto to engage a push-button such that upon pressing upon said base leg in a horizontal direction thereby causes said second leg means to engage and operate said push-button.

* * * * *